US005408578A

United States Patent [19]

Bolivar

[11] Patent Number: 5,408,578

[45] Date of Patent: Apr. 18, 1995

[54] TANKLESS WATER HEATER ASSEMBLY

[76] Inventor: Luis Bolivar, 10022 SW. 139th St., Miami, Fla. 33176

[21] Appl. No.: 8,481

[22] Filed: Jan. 25, 1993

[51] Int. Cl.[6] ..... F24H 3/06

[52] U.S. Cl. ..... 392/490; 392/485; 392/486; 219/483; 219/494; 219/481

[58] Field of Search ..... 392/486–491; 219/506, 491, 483, 486, 497, 494, 481, 485

[56] References Cited

U.S. PATENT DOCUMENTS

| | | | |
|---|---|---|---|
| 2,580,659 | 1/1952 | Corbett | 392/490 |
| 3,560,706 | 2/1971 | Forseca | 392/486 |
| 3,635,344 | 1/1972 | Lovitz | 392/486 |
| 4,095,087 | 6/1978 | Giraud | 392/490 |
| 4,233,694 | 11/1980 | Janosko et al. | 392/490 |
| 4,567,350 | 1/1986 | Todd, Jr. | 392/490 |

FOREIGN PATENT DOCUMENTS

| | | | |
|---|---|---|---|
| 0241748 | 9/1960 | Australia | 392/486 |
| 0757352 | 9/1956 | United Kingdom | 392/486 |

*Primary Examiner*—Mark H. Paschall

[57] ABSTRACT

A continuous flow water heater assembly requiring no storage tank and including an entrance chamber having a flow control switch mounted therein adapted to be activated upon a positive flow of water through the system wherein the water flows from the entrance chamber to a plurality of heating elements each of which are at least partially segregated by virtue of their being removably mounted within separate heating chambers. The heating chambers are attached in fluid communication to one another by a plurality, at least two, ports which are of proportionately different sizes such that water will be passed between the first and second heating chambers in proportionately different amounts through the different sized ports. Water is thereby effectively distributed between the heating elements so as to prevent exposure of the heating elements when activated and thereby eliminating either of the heating elements from being exposed to air and thereby subject to burnout.

14 Claims, 2 Drawing Sheets

TANKLESS WATER HEATER ASSEMBLY

BACKGROUND OF THE INVENTION

1. Field of the Invention

The present invention is directed to a tankless water heater assembly which is specifically adapted to heat water on a continuous basis as it passes from a conventional water source along a path of water flow through the system and into heat transferring relation to spaced apart, substantially segregated heating elements interconnected by more than one water directing connecting ports.

2. Description of the Prior Art

The most commonly used water heater assemblies for both domestic and commercial use involves the utilization of a rather large storage tank for water. Inefficiency is prevalent in these types of water heater assemblies due to the fact that the water maintained within such storage tanks is effectively reheated even when the water is not being utilized on a regular basis. To the contrary, an existing alternative to such storage tank water heater is the continuous flow or "tankless" water heaters wherein the water is almost instantaneously heated as it passes through the continuous flow system. It is recognized in the prior art that the tankless water heater assemblies are far more efficient from the standpoint of expending energy for the purpose of only heating water which is currently being used. However, such prior art continuous flow water heaters are also recognized as being significantly limited in flow delivery capacity by the heat input available. Such normal or existing factors in the continuous flow water heaters restrict the available hot water temperatures to less than satisfactory levels for a continuous flow requirements needed by most domestic and certainly by almost all commercial users.

An additional disadvantage associated with continues flow or "tankless" water heaters known in the prior art is their inability to actively regulate the output temperature as flow rates fluctuate without the use of expensive and complex controls. Another existing and well recognized problem associated with such type of instantaneous water heaters is their lack of reliability and their frequent break down or need for maintenance and repair. To a large extent this is caused by the inability to distribute equally and/or proportionately water between each of a plurality of individual heating units as water passes continuously through the heating system. Also the ability to remove, replace and/or repair the heating elements if a breakdown occurs would be of considerable advantage from a maintenance standpoint although such features are not well recognized in prior art and/or known in continuous flow water heaters of the type referred to herein.

The following patents are generally representative of continuous flow water heaters of the type referred to herein. The patent to Insley, U.S. Pat. No. 4,762,980 discloses an apparatus for electrically heating water utilizing at least two electrically powered heating resistance elements disposed sequentially along a path of flow but wherein separate chambers in which the separate heating elements are arranged are connected by a single common port or opening located at a common end of both the chambers and heating elements. Insley discloses his heating elements as a continuous electric resistance heating coil extending successfully through separate interior channels rather than two totally segregated elements. The heating coils controlled by temperature controller means having a temperature sensor to reduce or eliminate the effects of radiant energy generated by the heating coil on the temperature sensor. Insley also suggests the use of a TRIAC to regulate current flow to the continuous electric resistance heating coil. Insley does not show two spaced apart and effectively segregated heating coils each having electrical current being directed thereto under regulation by separate TRIACS such that proportional current flow may be directed when separately or concurrently activating the heating elements.

Eddas discloses an instantaneous fluid heater having a plurality of electrical heating elements wherein current is directed to the heating elements through control by means of a solid state switch and the use of a TRIAC type switch. Eddas therefore attempts to provide an instantaneous type water heater having temperature regulation to permit stored water to be maintained at a constant temperature while utilizing a plurality of heating elements as well as structure which is adapted to interrupt the flow of power through the heating elements when the fluid temperature exceeds an established pre-determined temperature. Eddas does not show the utilization of a flow control switch for purposes of initial activation nor does he completely describe the use of spaced apart segregated heating elements wherein water passes between the respective heating elements by a plurality of ports or channels which are proportionally dimensioned so that water flow may be exposed to the heating elements at different points along their length and in different amounts at such point.

Hurko, U.S. Pat. No. 4,808,793 discloses a tankless electric water heater having an instantaneous hot water output which includes an open ended folded tubular conduit having a separate metal sheath emerging heating element inserted into each end of the conduit. This patent also discloses the use of self regulating (PTC) heating cable either disposed in or wrapped around the tubular conduits which is continuously energized independently of the metal sheathed heating elements so as to maintain the water in the tubular conduits at a constant pre-determined temperature.

Davidson, U.S. Pat. No. 4,604,515 discloses a plurality of separate, serially connected heating chambers defining a water flow path from a cold water inlet port to a heated water outlet port wherein each chamber is provided with a separate heating element and a separate temperature sensor for producing a signal indicative of the water temperature within that chamber. Each of the heating elements are independently controlled by a control assembly responsive to signals from the temperature sensors in the respective heating chambers. By virtue of this assembly, each of the heating elements in a given chamber is energized only if the sensed water temperature in that chamber is too low.

Todd, U.S. Pat. No. 4,567,350 discloses an instantaneous electric water heater for both household and commercial use including a plurality of sequentially arranged individual heating chambers connected in series flow relationship between a cold water inlet and a hot water outlet wherein heating elements are energized by a flow switch at the time the hot water is demanded and are controlled by an adjustable thermostat which sets the outlet hot water temperature. An adjustable regulator is provided to assure that the water flow rate will not exceed the capacity of the heater to heat the water to a minimal acceptable level. It is important to note that there is no teaching in this patent of a plurality of proportionately dimensioned interconnecting ports so as to transfer or allow water flow between the chambers and into heat transferring engagement with the heating elements therein at various points along the length or dimension of the heating chamber so as to eliminate any exposure of the heating element to air when activated and thereby eliminate or seriously reduce the possibility of burnout.

Other U.S. patents relating to the subject of continuous flow water heaters include Maus, U.S. Pat. Nos. 4,900,896; Swindle, 4,467,178; Loeffalr, 4,823,770; Lutz et al, 4,970,373.

Based on the above there is still a need for an efficient high capacity continuous flow water heater which of course eliminates the problems and inefficiencies associated with storage tank water heaters and also which is capable of delivering an ample supply of hot water on a continuous basis and within acceptable temperature ranges. Such a preferred continuous flow water heater assembly should eliminate the problems of maintenance by significantly reducing the likelihood or possibility of burn outs of the one or more heating elements associated therewith.

SUMMARY OF THE INVENTION

The present invention relates to a continuous flow or tankless water heaters wherein water enters from a conventional supply or source into the subject assembly and is continuously heated as the water passes through a heating means, to be described in greater detail hereinafter, and passes outwardly therefrom at a desired, predetermined temperature for domestic or commercial use. More specifically the assembly passes through a water inlet into an entrance chamber in which a control switch assembly is movably mounted. The control switch assembly is more specifically defined as a flow control switch adapted to travel along with and in a common direction as the flow of water entering the entrance chamber through the aforementioned water inlet. The structural configuration and/or weight of the flow control switch is such that as water is forced in from the conventional water source at a somewhat standardized pressure (60 psi) the structural adaptation and configuration of the flow control valve forces it to travel along with the water flow to what may be considered a far or distal end of the elongated entrance chamber. The flow control switch includes a magnet mounted thereon and structured to move therewith along with the flow of water. The magnet when in its operative or activating position is in registry with a reed switch assembly which serves to activate or establish current flow to a plurality of electrical resistance heating elements defining the heating means of the present invention.

The reed switch is attached to and may define a portion of a control means associated with the subject assembly and structured to activate the assembly at least in terms of control of current flow to and from the heating elements as well as other operative components of the subject assembly. To this end, the control means comprises detail circuitry including but not limited to two separate TRIACS each of which are designed to regulate, on a proportional basis, current flow to each of two of the electrical resistance heating elements. The aforementioned circuitry of the control means is preferably mounted on a printed circuit board (PCB) and a thermistor serves as a sensing means which is strategically mounted in direct heat sensing relation to water passing into and through the heating means which will again be defined in greater detail hereinafter. The thermistor, defining the temperature sensing means is electrically connected to the control assembly.

A proportional control signal is supplied by the thermistor which senses the outlet hot water temperature. The thermistor reacts, through its change in resistance so as to determine the rate at which the power is supplied to the various heating elements. This maintains a fairly constant temperature in the water under varying conditions of water flow.

The PCB is located in close proximity to the magnetic flow switch and the reacting reed switch assembly. As set forth above when the magnet on the flow control switch is in registry with the reed switch the assembly is in a "on" current condition so that the control circuitry of the control means provides power to the heating elements. The PCB also contains a proportional controller chip which receives the temperature signal from the thermistor and generates proportional control pulses that adjust the amount of electrical power that is necessary to maintain the water temperature at the level that has been preset. This occurs through inner connection and activation of the aforementioned TRIACS which, as set forth above, proportionately regulate current flow to the heating elements.

Two external lights or light emitting diodes (LED) are viewable from the exterior of an outer support casing of the subject assembly. These are interconnected to the control means and are structured to indicate two separate functions. A first light will illuminate immediately upon the assembly receiving full intended current and power from the conventional power source. The illumination of this light serves to tell the user that if hot water is not being generated, he is at least assured that electrical power is being provided to the subject assembly. The second light serves as an effective malfunction light and will be continuously illuminated as long as there are no malfunctions in the various components or workings of the subject assembly. These lights will eliminate the assumed need to repair the assembly if in fact it is determinable that the unit for example is not receiving power. The illumination of both externally viewable lights on the outer support casing is evidence of the fact that power is being delivered to the assembly and that there are no malfunctions occurring.

The control means is also associated with a potentiometer type assembly which allows for the external manual adjustment or re-adjustment of the temperature which was previously pre-set at the factory or by other means. This therefore allows the user of the device to increase or decrease the temperature based on intended water flow through the unit particularly wherein the water flow or demand from the unit changes beyond that originally intended when the unit was pre-set at a pre-determined delivery temperature of say 145 degrees fahrenheit. However an internal limit for the potentiometer is provided so that under no circumstances will the water temperature exceed a value of 145 degrees fahrenheit in order to prevent harmful effects of dangerously hot water being issued from the assembly.

Continuing on with the path of flow water as it enters from a common source through the water inlet and into and from the entrance chamber and beyond and around the exterior surface of the flow control valve, the water next passes through a by-pass conduit or like structure and eventually through a bridge. The bridge serves a double function of serving to channel the water from the entrance chamber to the heating means but also serves as a heat sink. The normal operation of the TRIACS which are associated with the control means generates a significant amount of heat. The TRIACS are therefore mounted on the bridge portion of the conduit associated with and downstream of the by-pass conduit. A heat transfer will take place serving to remove excess and potentially damaging heat from the TRIACS during their operation as the water passes therethrough and into the heating means. The heating means comprises a first elongated heating chamber having an elongated electrical heat resistance element therein. In addition the heating means also includes a second elongated heating chamber having a second elongated heating resistance element therein. The interiors of the first and second heating chamber as well as the heating elements therein or at least partially or substantially segregated. However a plurality of ports for interconnecting channels (preferably two in number) are disposed in spaced apart relation to one another and are specifically disposed to allow the passage of water between the first chamber and the second chamber. An important feature of the present invention is the fact that a first of the two ports or connecting channels is located somewhat closer to what may be considered a proximal end of both of the heating chambers. The second port or connecting channel is located closer to the distal end and in specifically spaced apart relation to the first port. Also the two ports are specifically dimensioned and structurally adapted to allow different amounts of water to pass therethrough into spaced apart different portions of the heating chambers. This is to prevent burnout of either of the heating elements either when they are first being activated or alternately when there is a back flow and the water passes back from the two heating chambers towards the water inlet.

In a preferred embodiment to be described in greater detail hereinafter the first of the ports is proportionately smaller and accordingly allows the passage of proportionately less water therethrough between the lower proximal ends of the first and second chambers. To the contrary, the second port is spaced upwardly or closer to the distal ends of both of the first and second heating chambers and is proportionately dimensioned to allow a proportionately greater amount of water to pass therethrough between the upper portions of the first and second heating chambers. In a preferred embodiment the proportional sizes of the first and second ports is such that approximately only 15% of the water is allowed to pass through the first port between the first and second heating chambers and approximately 85% of the water is allowed to pass between the first and second heating chambers through the second port. By virtue of this structure substantially the entire length of each of the heating units will be constantly exposed or effectively submerged with water to be heated. This will thereby prevent any significant portion of either of the first or second heating units to be exposed to air and therefore subject to burnout or hot spots and damage for any prolonged length of time.

A water outlet having a compressed exit aperture is provided at the proximal end of the second heating chamber and at what may be considered the end of the path of water flow as the flow travels through the system from the water inlet to the water outlet. The dimension and structural adaptation of the water outlet is such as to allow a lesser amount of water to exit through the water outlet then enters through the water inlet wherein it is taken into consideration that the water pressure at the water inlet upon entering is approximately 60 psi. There will be somewhat of a "back pressure" of water throughout the entire system again to prevent the exposure to air of any portion of the heating elements for an extended period of time.

Other features of the invention include the ability of each of the heating units to be removably mounted within their respective heating chambers in order to independently allow the removable of either of the heating units for replacement or repair, when necessary, without effectively having to enter or disassemble any of the other components or portions of the subject heating assembly. Similarly, a cap or like structure is used to seal and cover an open end of the entrance chamber so as to provide access thereto as well as access to and removable of the flow control switch. The flow control switch may be desired to be replaced to vary the weight thereof and thereby regulate activation of the unit based on the amount of water flowing through the assembly or alternately access to the chamber and/or flow switch may be made for repair and/or replacement.

BRIEF DESCRIPTION OF THE DRAWINGS

For a fuller understanding of the nature of the present invention reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 2:
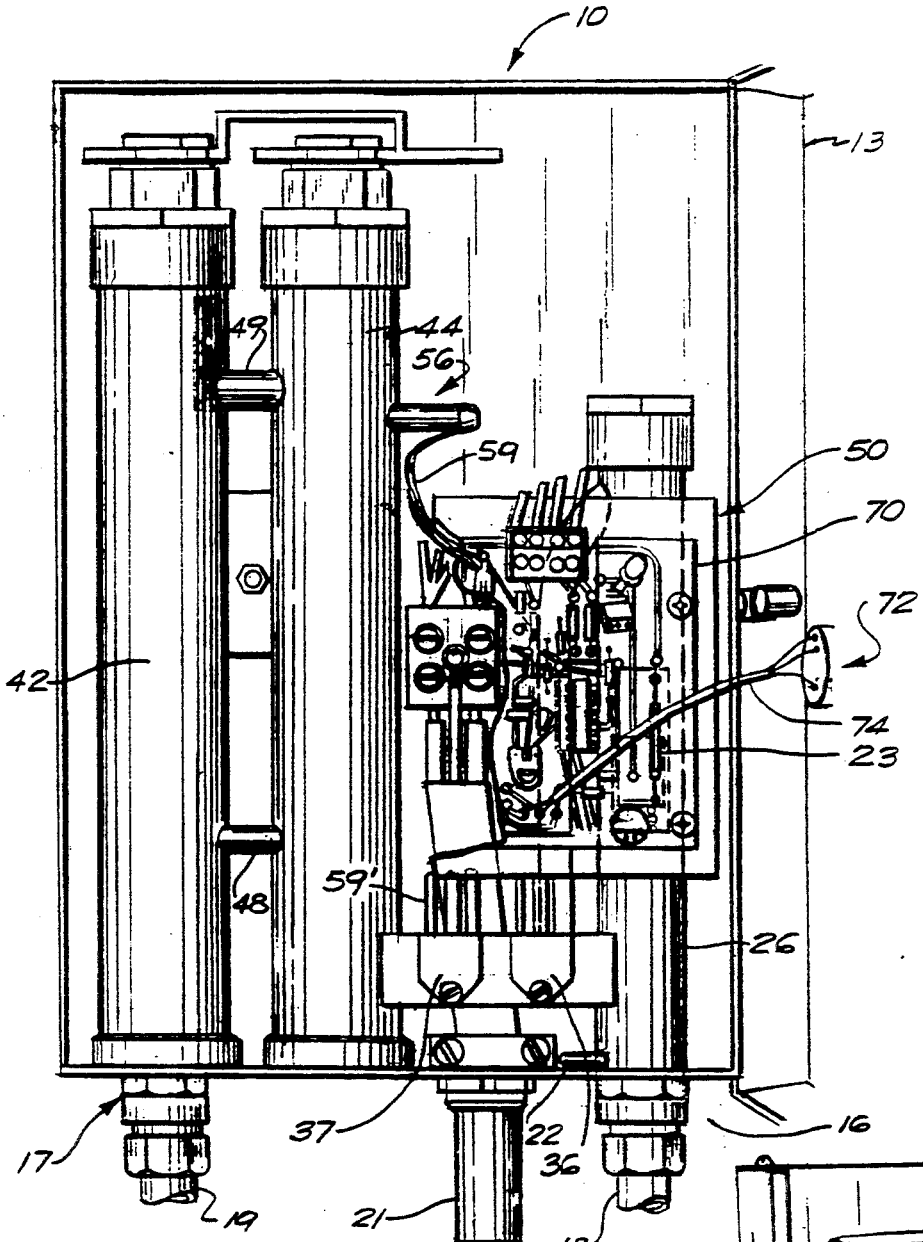
FIG. 2 is a front view and partial cutaway showing the interior components within the casing of the embodiment of FIG. 1 and the various components of the control assembly and circuitry defining a portion thereof.
Figure 3:
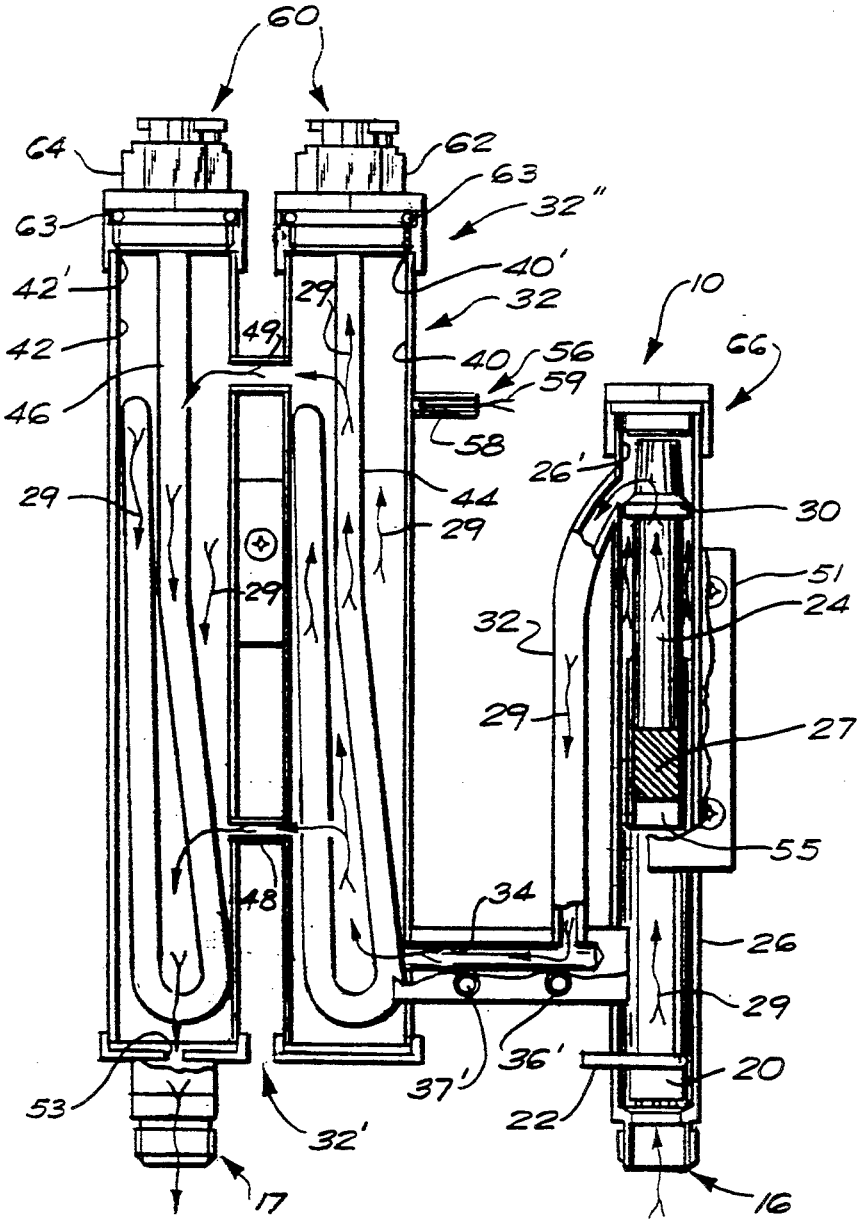
FIG. 3 is a schematic representation of the path of water flow through and the various components comprising the subject assembly.

As shown in the accompanying figures, the present invention is directed to a continuous flow water heater generally indicated as 10 and including an outer casing or housing generally indicated as 12 surrounding the components best shown in FIGS. 2 and 3 and to be described in greater detail hereinafter. The casing 12 includes a outer door or cover as at 13 which may be opened or removed to facilitate minimal access to the components as shown in FIGS. 2 and 3 and to effect at least minimal repairs. However, it should be emphasized that the structure and integrity of the components of the various invention minimizes the necessary for entering into the "guts" of the subject invention to accomplish mayor repairs. Referring to FIG. 3, the present invention comprises a water inlet generally indicated as 16 which is connected by a conduit 18 to a conventional source of water such as the city or municipal water supply. The inlet includes a filtering element as at 20 in order to eliminate any debris from entering into the system as best possible. An additional structure in the form of a stop or support member as at 22 is disposed and structured to cooperate with a control switch as at 24 which is mounted to travel reciprocally within an elongated entrance chamber 26. The flow control switch 24 carries a magnet as at 27 therein or attached thereto so as to travel therewith as the flow control switch moves in a direction indicated by the numerous directional arrows 29 indicating a positive path of flow of the water as it enters the water inlet 16 and exists from a water outlet generally indicated as 17. When the water passes into the entrance chamber 26 it will pass around the outer surfaces of the flow control switch 24. Travel of the flow control switch 24 along with the directional flow of water is facilitated by an outwardly extending somewhat peripheral flange as at 30 fixedly secured to the flow control switch.

Figure 4:
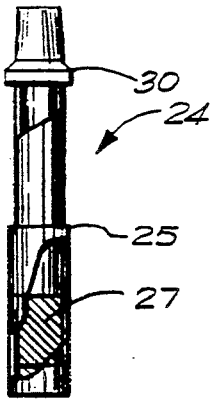
FIG. 4 is a front view and partial cutaway in section of an additional embodiment of a flow control switch of the subject assembly.
Figure 5:
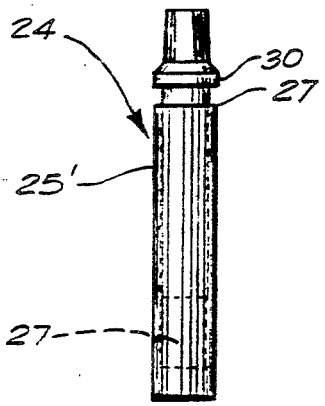
FIG. 5 is a front view in partial phantom of another preferred embodiment similar to that of FIG. 4.

Different embodiments of the flow control switch 24 are represented in FIGS. 4 and 5. More specifically each of the flow control switches in these two embodiments are fitted with a sleeve 25 and 25' respectively. The size and more specifically the length of the respective sleeves 25 and 25' serve to vary the weight of the flow control switch 24 and accordingly the amount or rate of flow of water entering into the entrance chamber 26. Therefore, a larger sleeve 25' may be utilized and mounted on the flow control switch 24 of FIG. 5 thereby requiring a greater rate of flow to pass into the inlet 16 and into the interior of the entrance chamber 26 in order to raise the flow control switch 24 of FIG. 5 to a point where the magnet 27 is in registry with the reed switch 23 which may form part of the control means 50 and be mounted on the printed circuit control board 70 shown in FIG. 2. Also, the length of the sleeve 25' positions its upper most end as at 27 closer to the flange 30. As explained herein, the flange 30 comes into contact with the water flow passing along the exterior surfaces of the flow switch 24 thereby aiding in its positioning or aiding in its travel with the water as it flows through the entrance chamber 26. Because of the fact that the upper most end 27 is in close proximity with the flange 30, a lesser amount of resistance will be offered to the water as it flows through the chamber thereby requiring a greater rate of flow to move the flow switch 24 of FIG. 5 into its upwardly or activating position.

To the contrary the embodiment of FIG. 4 is shorter and therefore is of lighter weight and is more easily moved with a lesser rate of flow of water entering the entrance chamber 26 so as to accurately position the flow switch 24 into its registry with the reed switch 23.

A bypass channel as at 32 serves to interconnect the entrance chamber 26 with the heating means generally indicated as 32. In addition the bypass channel is then connected directly to an additional conduit as at 34 which while serving to direct water flow into the interior of the heating means 32 also serves as a cooling bridge or heat sink for the mounting of TRIACS 35 and 37 (FIG. 2) which proportionately regulate electrical current flow to the electrical resistance heating element defined in greater detail hereinafter but considered a part of the heating means 32. The TRIAC mounts are indicated as 36' and 37' and such mounts are structurally adapted to transfer excess heat given off through operation and activation of the TRIACS which is a common occurrence and which is well known.

The heating means 32 includes a first elongated heating chamber 40 located downstream along the path of flow indicated by the directional arrows 29. The second heating chamber as at 42 is located upstream of the heating chamber 40 and is of the same elongated configuration. The interiors of such chambers each hold, respectively a different electrical resistance unit as at 44 and 46. The electrical resistance units extend substantially along the entire length of each of the respective heating chambers 40 and 42 and are powered or connected to receive electrical current from a common power supply connected to the control means which is generally indicated as 50 in FIG. 2 and will be described in greater detail hereinafter.

The chambers 40 and 42 as well as the respective heating units 44 and 46 therein are substantially isolated or segregated from one another but are specifically interconnected so that fluid communication is established between the respective interiors thereof. An important feature of the present invention is the provision of a plurality of interconnecting ports, preferably two in number, and more specifically indicated and defined by a first port or channel 48 and a second port or channel 49. These ports are located in spaced apart relation from one another and are spaced at different points substantially closer respectively to the proximal ends generally indicated as 32' and the distal ends of each of the chambers generally indicated as 32''. Also the ports 48 and 49 are specifically structured to be of proportionately different dimensions so as to regulate a proportionately different amount of water flow into different spaced apart locations of the first and second heating chambers 40 and 42. This will allow the at least partial filling of the proximal ends 32' of both the chambers 40 and 42 so as to at least partially submerge these proximal ends of the heating elements 40 and 46 while they are activated and are receiving current. At the same time the distal ends as at 32'' are also being exposed to water on a substantially proportional basis. More specifically, the entrance of water from the bridge or conduit 34 passes into the proximal end 32' of the first heating chamber 40. As the water rises in the heating chamber it will pass into the proximal end 32' of the second heating chamber 42 so as to contact and at least partially submerge the lower most end of the heating element 46. This will eliminate hot spots and resulting burnouts and accordingly reduce or eliminate damage to the heating elements 44 and 46 since spaced apart ends of such heating elements are almost concurrently being exposed to water flow. This minimizes the time that the entire length of the heating elements are exposed to air.

When the first and second heating chambers 40 and 42 are effectively filled and the heating units 44 and 46 are submerged heating of course takes place immediately upon the flow control switch 24 passing into its operative position as shown in FIG. 3. Once in this operative position the magnet 27 is in direct registry with the reed switch as at 23. The reed switch 23 is located externally of the flow control switch and is considered a part of and/or electrically connected to the control means 50 which is best defined in the form of a printed circuit board (PCB). A mount for the board is indicated as 51 and is mounted in the direct vicinity of the flow control switch and the entrance chamber as at 26.

Upon being heated the water exists from the assembly 10 through the water outlet 17. The water outlet 17 includes an exit opening or aperture as at 53 which is specifically defined as a compressed aperture having a relatively small size relative to the water inlet 16. The small opening 53 when compared to the water inlet opening as at 16 will create a somewhat back pressure throughout the entire system in order to again insure that the heating units 44 and 46 are not left exposed to air and therefore subject to hotspots or burnout and resulting damage. It should be further noted that while the directional arrows 29 are disposed to indicate a positive flow of water along the path of flow from the water inlet 16 to the water outlet 17, a back flow can occur throughout the entire system which will in effect dry the flow control switch from its operative position down towards the water inlet 16. To this end the aforementioned stop 22 is provided on which the flow control switch will be supported and will rest. The disposition of this stop member 22 is also such that it will not interfere with and become clogged or effectively attached to the water inlet 16 thereby preventing flow of water therethrough.

Other features associated with the flow control switch is the existence of a debris chamber as at 55 which will hold any fairly large amounts of debris or collected debris if in fact they are not removed by the filter 20 after passing into the interior of the entrance chamber 26 through the water inlet 16.

Another important feature of the present invention is best shown in FIGS. 2 and 3 and includes a temperature sensing means generally indicated as 56. The sensing means 56 is in the form of a thermistor, the activation and structure of which is well known in the art. The thermistor as at 58 is interconnected by conventional electrical conductors as at 59 to the control means 50 and serves to proportionately regulate current flow, through TRIACS 36 and 37 to the heating units 44 and 46 based upon the desired, pre-set temperature which is "built-in" to the unit through presetting of certain components of the control means 50.

It is further important to note that the placement of the temperature sensing means 56 is strategically made substantially near the larger of the two ports 49, because the temperature entering into the second heating chamber 42 after a minimal amount of time of exposure to the heating unit 46 will be substantially the same or the overall average of the temperature issuing from the assembly 10 will be substantially the same and a truer or more accurate indication of the pre-set temperature which was described above.

Other mechanical components of the subject assembly include mounting means associated with each of the heating units 44 and 46. Such mounting means is collectively indicated as 60 and comprises two plugs or like members 62 and 64 each of which are removably connected so as to overly, cover and seal an open end of the respective heating chambers 40 and 42 wherein such open ends are indicated as 40' and 42'. Seal means in the form of rings or other fluid seals are indicated as 63 and are considered to be a component of the individual plugs 62 and 64. The distal ends of each of the heating units 44 and 46 are fixedly connected to the plugs and are removable from the interiors of the respective heating chambers as the plug 62 and 64 are detached and removed. This allows for a maintenance and/or replacement of each or either of the heating units 44 and 46 without entering or effectively being involved in a detailed access to the various interior components of the subject assembly 10. Therefore maintenance is simplified just by removing one or both of the heating units independently of one another.

Similarly the heating chamber 26 includes a cover or cap member generally indicated as 66 which is disposed in sealing, covering relation to an open end as at 26' of the entrance chamber 26. Sealing occurs through conventional fluid sealing structure. Removal of the cap or cover 66 provides access to the interior of the entrance chamber 26 and also facilitates easy removal of the flow control valve 30.

Figure 1:
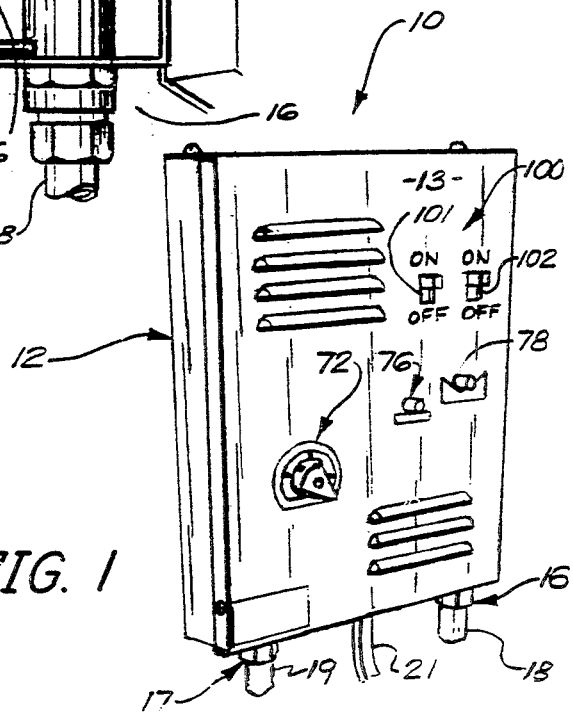
FIG. 1 is a perspective view in partial cutaway of the subject assembly housed in a protective and outer casing.

With reference primarily to FIGS. 1 and 2 the control means 50, as set forth above, comprises numerous electrical circuitry components including reed switch 23 wherein such components will not be described in detail but are indicated generally as 50. They in fact are mounted on the printed circuit board and may be considered a part thereof where the printed circuit board is generally indicated as 70. Interconnection through conventional electrical conductors to the temperature sensing device 56 occurs by conductors 59 and the various TRIACS are similarly connected by appropriate conductors as at 59'. Electrical power supplied through a covered electrical conduit as at 21 wherein the individual conductors as at 15 are in fact sheathed.

Of additional operation of the operation and functions of the control means 50 in the form of the PCB 70 relates to the operation of a potentiometer as at 72 which in effect allows the manual re-setting of the temperature of the water exiting from the assembly 10 as through the fluid conduit 19. The fluid conduit 19 is of course connected directly to the water outlet generally indicated as 17. When flow demands increase and/or the water temperature has been pre-set too low the usual operator may merely dial in a new temperature and/or flow rate through manipulation of the externally accessible dial (potentiometer structure) 72 which is electrically connected through a conductor as at 74 to the appropriate electrical components or circuitry components of the PCB 70. It should be noted that in no situation will the water exiting from the assembly 10 exceed a pre-set "high" temperature setting of 145 degrees in order to prevent harmful damage being done when such overly heated water is exposed to humans.

The further operation and activation of the control means 50 is further enhanced by means of two external indicators in the form of lights 76 and 78 which may be candescent bulbs, LCD or other sources of illumination. A first light as at 76 is illuminated and interconnected to the PCB 70 in a manner which will clearly indicate when electrical current flow is being supplied to the assembly 10 as through the electrical conductors 15 of the sheathed cable 21. This will allow the user or operator of the assembly 10 to provide clear indication that current is being supplied to the unit wherein proper current supply is doubted such as when hot water is not issuing from the assembly.

The second light 78 is interconnected to the PCB through proper circuitry and connections and is otherwise structurally adapted to indicate that proper current flow is being provided on a proportional basis to each of the heating units as at 44 and 46. Illumination of both lights or visual indicators 76 and 78 indicates that proper current flow is being delivered not only to the assembly 10 but to each of the units. If hot water is still not issuing from the assembly repair, maintenance and replacement of certain parts of the above noted components is indicated.

Another feature of the present invention is the inclusion, in certain preferred embodiments, of a testing facility more specifically defined by a switching assembly indicated as 100 in FIG. 1. The switching assembly 100 is more specifically defined by two separate independently operable micro switches 101 and 102. Each of the micro switches are electrically interconnected to the control means 50 and are specifically structured to interrupt and/or regulate the activating signal to the individual TRIACS 36 and 37. These TRIACS, as set forth above, regulate proportional current flow to the individual heating units 44 and 46.

In order to provide both a testing facility and also to selectively enable the user of the subject assembly to stop water flow and allow only cold water flow, when desired, the micro switches are capable and are specifically structurally adapted to render incapacitated the activation of the individual TRIACS 36 and 37. It is important to note that current flow per se from a given power source as through conductor 15 (FIG. 2) is not interrupted or regulated because such regulation of this current flow would require relatively large switching facilities capable of handling handling 30 amp current, for example. Due to the small size of the entire assembly 10 the micro switches are utilized to interrupt activating signals to each of the TRIACS 36 and 37 such that the TRIACS will not be operable until the micro switches are in their on or operable position thereby enabling current flow to be regulated proportionately and accurately from the incoming power source to the individual heating units 44 and 46.

By way of example each of the units 44 and 46 may be independently tested by virtue of the fact that the units may be independently de-activated leaving only one unit operable. If cold water continues to flow when one heating unit is supposed to be activated and one is purposely de-activated then the operator knows that the supposedly activated heating unit is burnt out or is inoperable. Similarly, if one desires to operate the entire assembly but only allow cold water flow to issue from the assembly, both of the heating units 44 and 46 may be selectively activated by moving the micro switches 101 and 102 to their off or inoperable position.

The actual circuitry for the micro switches 101 and 102 are not included here for purposes of clarity.

Now that the invention has been described:

What is claimed is:

1. A tankless water heater assembly designed to heat a continuous supply of water, said assembly comprising:

a) an entrance chamber connected in fluid receiving relation to a water inlet and including a control switch assembly including a flow switch mounted therein, b) a heating means adapted for heating water and including a first heating chamber having an elongated configuration and a second heating element mounted therein and a second heating chamber having an elongated configuration and a second heating element mounted therein, c) said second heating chamber and second heating element disposed downstream of said first heating chamber and first heating element and said second heating chamber including a water outlet mounted therein, d) a plurality of ports interconnected between said first and second heating chambers in spaced relation to one another and adapted to transfer water between said first and second heating elements, e) a path of flow of water defined successively by said water inlet, said entrance chamber, said first heating chamber, said plurality of ports, said second heating chamber and said water outlet, f) said plurality of ports comprising two ports disposed in spaced relation along a length of both said first and second heating chambers, a first of said two ports having a proportionately smaller transverse dimension than a second of said two ports and adapted to pass proportionately less water between said first and second chambers than said second port, g) said first port being disposed upstream of said second port along said path of flow of water and in closer spaced relation to substantially commonly disposed proximal ends of said first and second heating chambers than said second port and said second port being disposed in closer spaced relation to substantially commonly disposed distal ends of said first and second heating chambers than said first port, h) sensing means mounted along said path of flow and adapted for sensing temperature of water passing through said heating means, and i) control means operatively connected to said sensing means and said control switch assembly and adapted for regulating activation of an electrical current flow to said heating means dependent on flow rate and temperature of water passing along said path of flow of water.

2. An assembly as in claim 1 wherein said sensing means comprises a temperature sensor adapted to sense temperature of water passing through said heating means and disposed on said first heating chamber substantially adjacent to said second port.

3. An assembly as in claim 1 wherein said flow switch comprises a magnet mounted thereon and movable therewith and a read switch fixedly mounted externally of said flow control switch and electrically connected to said control means and disposed and adapted to be activated and establish current flow to said heating means once water flows along said path of flow from said water inlet towards said heating means.

4. An assembly as in claim 1 further comprising a stop member disposed and adapted to engage and maintain said flow switch out of incumbering engagement with said water inlet.

5. An assembly as in claim 1 wherein the water outlet is structurally adapted to pass less water therethrough than said water inlet whereby a back pressure of water is created within said second and first heating chambers respectively.

6. An assembly as in claim 1 wherein said water inlet comprises a filter means mounted adjacent thereto and adapted to filter debris from water passing into said entrance chamber through said water inlet.

7. An assembly as in claim 1 further comprising mounting means connected to each of said first and second heating elements and adapted to removably mount each of said first and second heating elements within said first and second heating chambers respectively.

8. An assembly as in claim 7 wherein said mounting means comprises two plug members each secured to an open end of a different one of said first and second heating elements and each plug member adapted to seal and be removably attached to said open end of a different one of said first and second heating chambers.

9. An assembly as in claim 8 wherein each of said plug members is adapted to independently be removed along with a corresponding one of said first and second heating elements from a corresponding heating chamber to which it is attached.

10. An assembly as in claim 9 further comprising a cap member removably mounted in covering relation to an open end of said entrance chamber and structurally adapted to provide access to an interior of said entrance chamber and said control switch assembly therein.

11. An assembly as in claim 1 further comprising a cap member removably mounted in covering relation to an open end of said entrance chamber and structurally adapted to provide access to an interior of said entrance chamber and said control switch assembly therein.

12. An assembly as in claim 1 further comprising a regulating switch means defining a portion of said control means and adapted to regulate electrical current flow from a source of electrical power to each of said first and second heating elements; a heat sink structure adapted to support and transfer heat from said regulating switch means.

13. An assembly as in claim 12 wherein said heat sink comprises a channel providing a portion of said path of flow and adapted to transfer water between said entrance chamber and said heating means.

14. An assembly as in claim 1 further comprising a switching assembly including a first and second micro switch each adapted to independently regulate an activating signal transmitted from said control means and intended to thereby regulate current flow to a different one of said first and second heating elements.

* * * * *